United States Patent [19]

Stiklorus

[11] 4,145,017

[45] Mar. 20, 1979

[54] GLIDE PROJECTILE HAVING JETTISONABLE KEEL FIN

[75] Inventor: Lothar Stiklorus, Ottobrunn, Fed. Rep. of Germany

[73] Assignee: Messerschmitt-Bolkow-Blohm GmbH, Fed. Rep. of Germany

[21] Appl. No.: 793,508

[22] Filed: May 4, 1977

[30] Foreign Application Priority Data

Oct. 27, 1976 [DE] Fed. Rep. of Germany ..... 2648523

[51] Int. Cl.[2] ..... F42B 15/10; F42B 13/30

[52] U.S. Cl. ..... 244/3.25

[58] Field of Search ..... 244/3.1, 3.24, 3.25; 102/3

[56] References Cited

U.S. PATENT DOCUMENTS

| | | | |
|---|---|---|---|
| 1,228,281 | 5/1917 | Barrett | 244/3.1 |
| 2,597,703 | 5/1952 | Busaker | 244/3.25 |
| 2,634,924 | 4/1953 | Brown | 244/3.25 |
| 2,973,164 | 2/1961 | Grill | 244/3.25 |

*Primary Examiner*—Verlin R. Pendegrass

*Attorney, Agent, or Firm*—McGlew and Tuttle

[57] ABSTRACT

A non-spinning glide projectile, comprises a body which includes a forward portion having one or more lift-producing devices or outwardly projecting air foil-like surfaces. A keel fin is detachably secured to the body intermediate its length, and means, such as a time fuse device, carried on the body, is employed for detaching the fin and jettisoning it after a predetermined flight path has been completed.

4 Claims, 2 Drawing Figures

GLIDE PROJECTILE HAVING JETTISONABLE KEEL FIN

FIELD AND BACKGROUND OF THE INVENTION

The present invention relates in general to missile constructions and, in particular, to a new and useful non-spinning glide projectile which is equipped with lift-producing devices and a keel fin.

DESCRIPTION OF THE PRIOR ART

In a glide projectile, the weight of which is completely or partly compensated by the lift produced by lift-producing devices provided on the projectile, for example, a pair of fins in angular positions relative to the longitudinal axis of the projectile, a rotary motion of the projectile about its longitudinal axis causes a deviation from the initial direction of flight. Therefore, it is known for a long time (French Patent No. 496,758) to provide the projectile with a keel fin which, upon a yaw disturbance at launching or in cross-wind, rotates the projectile about the longitudinal axis thereof in a manner such that the lift-producing devices compensate for the deviation caused by the yaw disturbances or the cross-wind.

However, the effect of a keel fin is different, depending on whether a yaw disturbance or a cross-wind is concerned. Thus, a glide projectile with a keel fin is substantially more sensitive in its response to yaw disturbances that it is to a cross-wind. Consequently, if the keel fin is dimensioned, for example, to compensate for the initial yaw occurring after the launching of the projectile, its effect is not sufficient to compensate for the influence of the cross-wind during flight. If, on the other hand, the keel fin is dimensioned for compensating the deviation due to the cross-wind, the initial yaw will be overcompensated, i.e., the deviation in the opposite direction imparted to the projectile at launching will be excessive.

SUMMARY OF THE INVENTION

The present invention is directed to a non-spinning glide projectile equipped with lift-producing devices and a keel fin, making it possible to compensate for disturbances due to both yawing motion and to cross-winds in a manner such that in the end effect, the accuracy of hit is improved.

For this purpose, in accordance with the invention, the keel fin is constructed so as to be separable from the projectile body at an adjustable point of time after the launching of the glide projectile. With a suitable choice of the keel fin size and the instant of jettisoning, the effect is then obtained that the deviations due to initial yaw and to cross-wind are compensated in an equally satisfactory manner.

The size of the keel fins and the instant of jettisoning may be determined, for example, as follows:

With the aid of a trajectory simulator, the lateral deviations of a projectile without keel fin are determined for the considered range, both for an average cross-wind and an average initial yaw. Further and again with the aid of a trajectory simulator and for a projectile without keel fin, the initial rolling velocities are determined which produce the same lateral deviation at the same disturbances with an opposite sign. The rolling velocity for compensating the initial yaw is lower than that for compensating the cross-wind. Now, again with the aid of a trajectory similator, but for the same projectile with a keel fin, the variation in time of the initial rolling velocity is determined, first, due to the cross-wind and, second, due to the initial yaw. From this variation in time of the rolling velocities, the point of time (instant of jettison) is determined at which the rolling velocities caused by cross-wind and caused by initial yaw show the same ratio as the respective initial rolling velocities previously determined for the projectile without keel fin. While taking into account the parameters of the projectile, such as mass, moment of inertia, etc., the size of the keel fin is now chosen so as to actually obtain the rolling velocities determined for the instant of jettison.

Either a delay-action mechanism to be released at the instant of launching or a time fuse device is provided to jettison the keel fin from the projectile.

Accordingly, it is an object of the invention to provide a non-spinning glide projectile body having lift-producing devices and a keel fin adapted to depend downwardly from the body intermediate its length with means on the body for separating the keel fin from the body during the flight thereof.

A further object of the invention is to provide a non-spinning glide projectile which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figure 1:
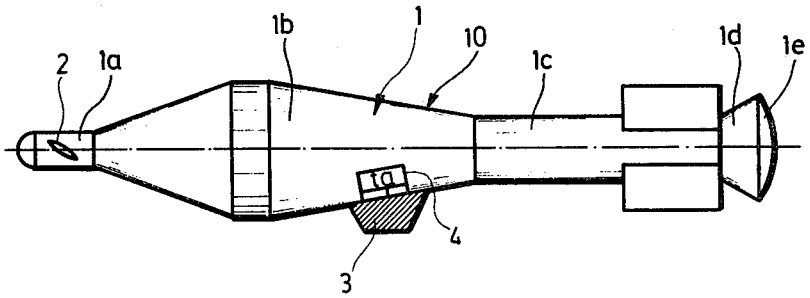
FIG. 1 is a diagrammatical view of one embodiment of a glide projectile constructed in accordance with the invention.

Referring to the drawings in particular, the invention embodied therein, comprises a glide missile or projectile, generally designated 10, which includes a fin-stabilized projectile body, generally designated 1, having a forward portion 1*a*, an intermediate wide diameter portion 1*b* and a trailing portion 1*c* of uniform diameter which advantageously terminates in a thrust portion 1*d*, having a thrust nozzle diacharge 1*e*.

The fin-stabilized glide projectile body 1, shown in FIG. 1, is provided on its nose 1*a* with lift-producing devices in the form of a pair of fins 2, 2, on respective diametrically opposite sides and only one of which is shown. A keel fin 3 is provided in the middle portion 1*b* of the projectile body, which is detachably connected to the projectile body, in accordance with the invention, through a time fuse 4. Time fuse 4 advantageously includes a delay-action mechanism. After an adjustable period of time of time $t_a$ following the launching of the projectile, the keel fin 3 is detached from the projectile body and falls down. Thus, the action of the keel fin is limited to the initial phase of flight of the glide projectile. During this period of time, the projectile is deviated to the extent corresponding to an average cross-wind and an average initial yaw, which deviation is compensated again during the further flight, due to the influence of the cross-wind.

Figure 2:
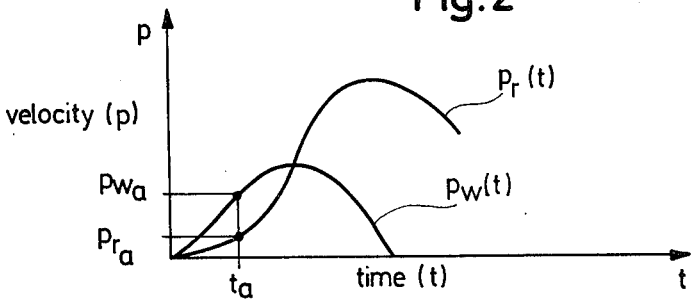
FIG. 2 is a graph showing the qualitative variation in time of the rolling velocity due to cross-wind and initial yaw of a projectile equipped with any keel fin, and serving the purpose of determining the instant of jettison.

The size of the keel fin and the exact instant of jettison may be determined in the above-described manner. In order to further explain the determination of the instant of jettison, the graph of FIG. 2 shows the variation of the rolling velocity of a projectile equipped with a keel fin under the influence of an average cross-wind curve $P_r(t)$ and under the influence of an average initial yaw curve $P_w(t)$. Curves $P_r(t)$ and $P_w(t)$ show the qualitative variation of the rolling velocity for a cross-wind and an initial yaw, respectively. Now, for a definite range, on the time axis, the time $t_a$ is determined at which the ratio of the corresponding velocities $Pw_a$ and $Pr_a$ is the same as the ratio of the initial rolling velocities which have been determined with the aid of a trajectory simulator and cause the same lateral deviations as have been calculated with a glide projectile without a keel fin, but of the same range, for an average initial yaw and an average cross-wind having an opposite sign. The point of time $t_a$ thus determined is the instant of jettison for the keel fin, which is to be adjusted in the time fuse 4 prior to launching the projectile.

While a specific embodiment of the invention has been shown and described in detail to illustrate the application of the principles of the invention, it will be understood that the invention may be embodied otherwise without departing from such principles.

What is claimed is:

1. In a non-spinning glide projectile under the influence of a cross-wind and an initial yaw having a body and at least one lift-producing device on the body, an improvement comprising, an aerodynamic keel fin on the body intermediate the length thereof of a size sufficient for causing a roll of the glide projectile to compensate for the cross-wind and initial yaw thereof, and means for separating the keel fin from the body at a time when the ratio between the value of a roll needed to compensate for the cross-wind and for the initial yaw is substantially equal to the ratio between a roll needed to compensate for a cross-wind and for an initial yaw in a glide projectile without said keel fin.

2. In a non-spinning glide projectile, according to claim 1, wherein said means for separating the keel fin comprises a time fuse.

3. In a non-spinning glide projectile, according to claim 1, wherein said means for separating said keel fin from said projectile body includes a delay-action mechanism.

4. In a non-spinning glide projectile, according to claim 1, wherein the body includes a forward nose portion, the at least one lifting device on said body comprising an air foil lift surface on each side of said nose portion, the body including an intermediate portion having a larger diameter than said nose portion, and a trailing portion having a diameter smaller than said intermediate portion terminating in a thrust discharge.

* * * * *